US009526314B2

(12) United States Patent
Wakamatsu et al.

(10) Patent No.: US 9,526,314 B2
(45) Date of Patent: Dec. 27, 2016

(54) SLIDING MAKEUP IMPLEMENT

(71) Applicant: Japro Inc., Iwaki-shi (JP)

(72) Inventors: Kiyoshi Wakamatsu, Kashiwa (JP); Eiichiro Miyoshi, Kashiwa (JP); Shigeo Suda, Tokyo (JP)

(73) Assignee: JAPRO INC., Iwaki-Shi (JP)

( * ) Notice: Subject to any disclaimer, the term of this patent is extended or adjusted under 35 U.S.C. 154(b) by 0 days.

(21) Appl. No.: 14/774,442

(22) PCT Filed: Jun. 27, 2013

(86) PCT No.: PCT/JP2013/067693

§ 371 (c)(1),
(2) Date: Sep. 10, 2015

(87) PCT Pub. No.: WO2014/207869

PCT Pub. Date: Dec. 31, 2014

(65) Prior Publication Data

US 2016/0022007 A1 Jan. 28, 2016

(51) Int. Cl.
*A45D 40/02* (2006.01)
*A45D 40/20* (2006.01)
(Continued)

(52) U.S. Cl.
CPC ..... *A45D 40/02* (2013.01); *A45D 40/12* (2013.01); *A45D 40/205* (2013.01); *A45D 40/24* (2013.01); *A45D 2040/207* (2013.01)

(58) Field of Classification Search
CPC ..... A45D 40/02; A45D 40/023; A45D 40/12; A45D 40/205; A45D 2040/207; B43K 24/04; B43K 24/12
(Continued)

(56) References Cited

U.S. PATENT DOCUMENTS 2,196,127 A * 4/1940 Stogran ..... A45D 40/023 401/86
3,046,943 A * 7/1962 Rhoades ..... B43K 24/02 401/117
(Continued)

FOREIGN PATENT DOCUMENTS

JP 32-15648 12/1957
JP 50-35902 10/1975
(Continued)

OTHER PUBLICATIONS

International Search Report dated Sep. 17, 2013 issued in International Application No. PCT/JP2013/067693 filed Jun. 27, 2013.

*Primary Examiner* — Jennifer C Chiang
*Assistant Examiner* — Bradley Oliver
(74) *Attorney, Agent, or Firm* — Jacobson Holman, PLLC.

(57) ABSTRACT

A sliding makeup implement includes a pair of case members that are obtained by dividing a case into two in a protruding direction of a rod-shaped core, one divided case member being slidably combined with the other divided case member. Sliding grooves are respectively formed in inner surfaces of the divided case members for arranging the rod-shaped core so that the core can be advanced and retracted in an axial direction. A core holder is movable along the sliding grooves and holds the core at a base end thereof. Coupling means for pushing out the core by means of one case member and for bringing the one case member and the core into a coupled state when the pushed-out core is returned to its original position, and for bringing the one case member and the core into an uncoupled state when the core is left at the pushed-out position.

5 Claims, 5 Drawing Sheets

(51) Int. Cl.
*A45D 40/24* (2006.01)
*A45D 40/12* (2006.01)

(58) Field of Classification Search
USPC ..... 401/86
See application file for complete search history.

(56) References Cited

U.S. PATENT DOCUMENTS

| | | | | |
|---|---|---|---|---|
| 5,044,805 | A * | 9/1991 | Kosteniuk | B43K 24/04 401/82 |
| 6,290,413 | B1 * | 9/2001 | Wang | B43K 24/04 401/30 |
| 6,695,511 | B2 * | 2/2004 | Lundak | A45D 40/205 401/117 |
| 7,677,824 | B2 * | 3/2010 | Yoon | B43K 24/04 401/103 |
| 2013/0230348 | A1 * | 9/2013 | Kurek | A45D 40/023 401/88 |

FOREIGN PATENT DOCUMENTS

| | | |
|---|---|---|
| JP | 54-21180 | 7/1979 |
| JP | 59-27207 | 8/1984 |
| JP | 59-39965 | 11/1984 |

* cited by examiner

SLIDING MAKEUP IMPLEMENT

TECHNICAL FIELD

The present invention relates to a sliding makeup implement having a configuration in which a rod-shaped core used for makeup can be advanced and retracted from a case when being used.

BACKGROUND ART

As makeup implements having a rod-shaped core as a makeup material, for example, eyebrows, eyeliners, lip liners, and the like, have been widely used. A rod-shaped makeup material is housed in a case, is fed by a suitable length and used like a writing material when required, and is housed in the case after use. A related-art type in which a makeup material is moved is referred to as a feeding type, and is representatively used for a lipstick.

However, in the case of the feeding type, it is natural that a mechanism for feeding the makeup material is required. As the feeding mechanism, for example, a cam mechanism is used. Although to movement distance can be accurately and easily adjusted by the cam mechanism, this cam mechanism cannot be easily adopted. This is because the use of the cam mechanism leads to problems that a complicated system is also required for manufacturing feeding makeup implements, costs also become high, and commodity prices are pushed up.

There is Japanese Examined Utility Model. Registration Application Publication No. S32-15648 in one of those that were found through prior-art search. In this publication, by pushing in an end of an inner cylinder, to push-open part is applied on an elastic sandwiching plate, and a shaft of which the point is a pen is exposed. However, in this structure, there is no idea of adjusting the amount of exposure simply by selecting either appearance or disappearance of the pen. Additionally, Japanese Examined Utility Model Registration Application Publication No. S50-35902 discloses a configuration in which a holder having a tapered notched groove is made to hold, a makeup rod, a notched groove is pushed wide by a ridge, and the makeup rod is pushed out. Therefore, even if the operation of pushing out the makeup rod becomes slightly easy, there are problems in that the shape of parts is special and the number of parts also increase.

[Patent Citation 1] Japanese Examined Utility Model Registration Application Publication No. S32-15648

[Patent Citation 2] Japanese Examined Utility Model Registration Application publication No. S50-35902

DISCLOSURE OF INVENTION

Technical Problem

The invention has been made in view of the above actual circumstances, and an object thereof is to provide a make-up implement that has a sliding configuration which is simpler than complicated feeding configurations and that is capable of easily and accurately adjusting the length of advance/retraction of a rod-shaped core. Additionally, another object of the invention is to provide a sliding makeup implement that can manufacture at low costs and is easily used.

Technical Solution

In order to solve the problem, according to the invention, there is provided a sliding makeup implement having a configuration in which a rod-shaped core used for makeup is capable of being advanced and retracted from a case when being used, the sliding implement including a pair of case members that are obtained by dividing a case into two in a protruding direction of a rod-shaped core, the one divided case member being slidably combined with the other divided case member; sliding grooves that are respectively formed in inner surfaces of the divided case members for arranging the rod-shaped core so that the core is capable of being advanced and retracted in an axial direction thereof, a core holder that is movable along the sliding grooves and holds the core at a base end thereof, and coupling means for pushing out the core by means of one case member and for bringing the one case member and the core into a coupled state when returning the pushed-out core to its original position, and for bringing the one case member and the core into an uncoupled state when leaving the core at the pushed-out position.

The makeup implement, of the invention is characterized by being the slide type. There are makeup implements that are devised so as to be easily used, particularly, so that the length of advance/retraction of the rod-shaped core can be easily and accurately adjusted, and achieve desired results, while being the slide type. Therefore, the makeup implement of the invention includes the pair of case members that are obtained by dividing the case into two in the protruding direction of the rod-shaped core, the one divided case member be slidably combined with the other divided case member, and exit and entry of the rod-shaped core is performed by the sliding between the case members.

The sliding grooves are respectively formed in the inner surfaces of the pair of case members that are slidably combined with each other, and the core holder that holds the core at the base end thereof is provided in the sliding grooves so as to be movable along the sliding grooves. The core holder constitutes a portion of the coupling means capable of being coupled to the one case member. The coupling means is provided to push out the core by means of the one case member, and to bring the one case member and the core into the coupled state when the pushed-out core is returned to its original position and bring the one case member and the core into the uncoupled state when the core is left at the pushed-out position.

The coupling means may include, for example a first coupling hole that is formed in a core holder in a direction intersecting the axial direction of the core; a second coupling hole that is formed in one of the case members and is located at a position where the second coupling hole is aligned with the first coupling hole when the core holder is located deep in the sliding grooves; and a coupling pin that is movably provided inside the first and second coupling holes, and the dimension of the coupling pin may be set to be shorter than the length of the first coupling hole and longer than the length of the second coupling hole. By setting the dimension of the coupling pin so as to be shorter than the first coupling hole and longer than the second coupling hole, the coupling pin can take a state where the coupling pin is in only the first coupling hole, and a state where the coupling pin is caught in the first and second coupling holes.

Additionally, the case may be formed of a transparent material to make the movement invisible or an indicator showing a moved position is provided on the case, in order to grasp a position where the coupling means has moved, from the outside. Since the transparent case makes the movement of the coupling pin visible, this is preferable for the device of the invention. Additionally, even in an opaque case, the position of the coupling pin can be indirectly indicated by giving the indicator, such as an arrow.

It is a desirable configuration that the core holder has a fitting relationship in which the core holder is slidable along the sliding grooves and is capable of stopping at an arbitrary position, and a drag in the fitting is set to be greater than a pressure applied to the core when being used. Although this configuration is required in order to withstand the pressure applied as a reactive force from skin when the core is pushed out and used, the point is that the core and its core holder should be pushed back while the makeup implement is used. Therefore, even if frictional resistance is increased or minute engagement or the like is caused between the core holder and the sliding groove, it can be used as drag against the pushing-back.

Additionally, in the sliding makeup implement of the invention, as a core retaining mechanism, it is preferable that the core holder is provided with a protrusion, a sliding groove is provided with a guide groove in which the protrusion is movable, and a tip of the guide groove is used as a stop part. This mechanism can prevent a situation in which the case is excessively pushed out and the core or the like slips out.

Advantageous Effects

Since the invention, as described above, has the sliding configuration that is simpler than complicated feeding configurations and has the movable coupling means that brings the case member and the core into the coupled state or the uncoupled state, the invention exhibits an effect in which the length of advance/retraction of the rod-shaped core can be easily and accurately adjusted. Additionally, since the configuration of the invention is a simple configuration, the invention can be manufactured at low costs. Additionally, since the amount of advance/retraction of the core can be controlled by the exit and entry of the case member, the invention can provide the sliding makeup implement that is easily used.

Best Modes for Carrying Out the Invention

Hereinafter, the invention will he described in detail with reference to an illustrated embodiment. FIGS. 1 and 2 relate to Example 1 of a sliding makeup implement 10 related to the invention, a case 11 consist of a pair of case members 12 and 13 and is obtained by dividing the case into two along a protruding direction of a rod-shaped core 16, and the one divided case member (12) is slidably combined with the other case member (13). The above sliding configuration is provided on the bisected surfaces, and in the illustrated embodiment, a dovetail foot-type convex portion 14 is formed on the surface of one case member 12, a dovetail groove-type concave portion 15 is formed in the surface of the other case member 13 (refer to FIG. 3F), and these portions have slidable structure.

In the case of the embodiment, referring to FIGS. 3A and 3F, it can be seen that the one case member 12 is set to be smaller than the other case member 13 as if a portion of an upper part of the case 11 is formed so as to be cut off. Therefore, a portion 13*a* of the other case member 13 that is left without being cut off contributes to holding of the other case member 13 when the one case member 12 is operated. An end surface. 13*b* is present at the cutoff portion of this portion 13*a,* and the end surface 13*b* becomes a surface that defines an original position when the one case member 12 is returned. Additionally, a thumb rest 12*a* for operation is provided on an outer surface of the one case 12. Although the illustrated thumb rest 12*a* is an indentation of the outer surface, it is needless to say that this may be changed to a projection.

The rod-shaped core 16 is illustrated for eyebrows or the like in the embodiment of Example 1, and the core 16 is held by a core holder 17 at a base end thereof (refer to FIG. 3C). The core holder 17 is formed in a sectional shape such that the core holder is fitted to sliding grooves 10 and 19 (to be described below) to cause moderate drag, has a holding part 17*a* on one end side thereof, and holds the core 17 by an end of the core 16 being fitted into the holding part 17*a*. Additionally, although the core holder 17 has a first coupling hole 21 constituting coupling means on the other end side, this will be described in detail in the paragraph of the coupling means 20.

The aforementioned sliding grooves 18 and 19 are respectively formed in inner surfaces of the bisected case members 12 and 13 so that the core 16 and the core holder 17 can be advanced and retracted in the axial direction thereof, and almost the entirety of the attached core 16 is settled in the core holder 17. The core holder 17 has a sectional shape such that the core holder can fit to the sliding grooves 18 and 19 so as to be slidable along the sliding grooves 18 and 19, and has a fitting relationship with the sliding grooves 18 and 19 in order to obtain a state where the core holder can stop at an arbitrary position, and the drag in the above fitting is set to be greater than a pressure applied to the core 16 when being used.

In the invention, coupling means 20 is provided to push out the core 16 by means of the one case member 12, and to bring the one case member 12 and the core 16 into a coupled state when the pushed-out core 16 is returned to its original position and bring the one case member 12 and the core 16 into an uncoupled state when the core 16 is left at the pushed-out position. The coupling means 20 of the invention moves the core 16 in both advance and retraction directions in the coupled state of the one case member 12 and the core 16. Meanwhile, since the one case member 12 can also be pushed by an end 18*a* of the sliding groove 18 of the core holder 17, advance is also possible in the uncoupled state (refer to FIG. 3; however, the case member cannot be retracted). In addition, although the one case member 12 is able to hit the end surface 13*b* of the other case member 13 at the base end 12*b* when being retracted, the one case member is in a state where the one case member is returned to its original position.

The coupling means 20 includes a first coupling hole 21 that is formed in the core holder 17 in a direction intersecting the axial direction of the core 16, a second coupling hole 22 that is formed in the one case member 12 and is located at a position where the second coupling hole is aligned with the first coupling hole 21 when the core holder 17 is located deep in the sliding grooves, and a coupling pin 23 that is movably provided inside the first and second coupling holes 21 and 22 (refer to FIGS. 3B and 3C). The coupling pin 23 is arranged at the core holder 17 at a position where the coupling pin has approached the second coupling hole 22 side (refer to FIG. 6C), and the dimension of the coupling pin 23 is set to be shorter than the length of the first coupling hole 21 and longer than the length of the second coupling hole 22. In addition, the first coupling hole 21 formed in the core holder 17 and the second coupling hole 22 provided in the one case member 12 should coincide with each other at their original positions.

Moreover, the sliding makeup implement 10 of the invention have a core-retaining mechanism (particularly, refer to FIGS. 3D and 3E). The illustrated core-retaining mechanism is configured such that the core holder 17 is provided with a protrusion 29, a sliding groove 19 is provided with a guide groove 30 in which the protrusion 29 is movable, and a wall rising from the tip of guide groove 30 is used as a stop part 30*a*. Since slip-out of the core 16 and the one case member 12 is prevented by such a core-retaining mechanism, for example, even if operation is made it by groping, the invention can be comfortably used.

How to use the sliding makeup implement 10 of Example 1 configured in this way will be described with reference to FIGS. 4 to 6. In addition, the embodiment is provided by the case 11 being formed of a transparent material that makes the above movement visible in order to grasp as position where the coupling means 20 has moved, from the outside. FIG. 4 illustrate a state where the sliding makeup implement 10 of Example 1 is not used, and the first coupling hole 21 formed in the core holder 17 and the second coupling hole 22 provided in the one case member 12 are located at their original positions.

The position of the first coupling hole 21 and the position of the second coupling hole 22 coincide with each other at the original positions, and the makeup implement 10 is placed such that the first coupling hole 21 is located at the top and the second coupling hole 22 is located at the bottom. Accordingly, the coupling pin 23 is moved due to gravity and a lower end of the coupling pin enters the second coupling hole 22 to bring the one case member 12 and core holder 17 into the coupled state. Therefore, the core 16 (core holder 17) is also moved together with the one case member 12 by pushing out and advancing the one case member 12. FIG. 5 illustrate a state where the one case member 12 has been pushed out together with the core 16.

When such a core 16 is left at the pushed-out position, the posture of the coupling means 20 is changed upside down such that the second coupling hole 22 is located at the top and the first coupling hole 21 is located at the bottom, the coupling pin 23 is made to slip out of the second coupling hole 22 due to its gravity movement, and the one case member 12 and core holder 17 are brought into the uncoupled state (refer to FIG. 6). Then, by maintaining this state and retracting the one case member 12, the core holder 17 in the uncoupled state is left at the pushed-out position. Although FIG. 6 illustrate a state where the core 16 has been pushed out, the amount of advance/retraction can be easily added or subtracted by the operation of the thumb rest 12*a*.

In addition to the above case where the advance of the core 16 is performed in the coupled state of the one case member 12 and the core holder 17, the core 16 (core holder 17) can be moved as mentioned by pushing the core holder 17 with the end 18*a* of the sliding groove 18 of the one case member 12 even if the one case member 12 and the core holder 17 are in the uncoupled state. By adopting such a configuration, operation becomes easier because the core 16 can be left at the pushed-out position simply by returning the one case member 12 to its original position after the core 16 is pushed out by an arbitrary length.

The sliding makeup implement 10 having only one core 16 has been described in Example 1 of the above embodiment. However, according to the invention, since a sliding makeup implement 24 having two cores 16 can also be provided, such a sliding makeup implement 24 will be described as Example 2. As is clear from FIG. 7, the sliding makeup implement 24 of Example 2 have one elongated case 25, case members 26*a* and 26*b* are provided on front and rear sides from a central portion of the elongated case, and the other case member 27 are provided integrally with the front and back case members.

Hence, the sliding makeup implement 24 of Example 2 is equivalent to one obtained by combining and integrating two sliding makeup implements 10 of Example 1. In addition, a constituent element for functioning as the sliding makeup implement may be the same as that of the aforementioned Example 1, and hence, the detailed description thereof will be omitted. Since front and rear cores 28*a* and 28*b* are provided in the case of Example 2, it is possible to select and use two different core colors. In that case, operation is easier if two second coupling holes 22 that bring the respective case members 26*a* and 26*b* and the cores 28*a* and 28*b* into a coupled state are provided side by side on the same side in order to simultaneously use the front and rear cores 28*a* and 28*b*.

According to the embodiment of Examples 1 and 2 of the invention configured in this way, the posture of the case 11 is changed, so that the coupling pin 23 can be moved due to gravity, and the respective case members 12, 26*a*, and 26*b* and the core 16 (core holder 17) can be set to the coupled state even in the uncoupled state. Since the amounts by which the respective case members 12, 26*a*, and 26*b* are pushed out can be added or subtracted if a larger force than the drag of the core holder 17 having the relationship of fitting so that the core holder is slidable along the sliding grooves 18 and 19 and can be stopped at an arbitrary position is applied, operation is also easy,

BRIEF DESCRIPTION OF THE DRAWINGS

FIG. 3A is a side view of one case member, FIG. 3B is a plan perspective view of the one case member, FIG. 3C is a plan view of the core, FIG. 3D is also a side view of the core, FIG. 3E is a plan view of the other case member, FIG. 3F is a side view of the other case member, and FIG. 3G is an end view illustrating the sliding makeup implement of Example 1.

FIG. 4A is a plan view, FIG. 4B is side view, and FIG. 4C is a partial sectional view.

FIG. 5A is a plan view, FIG. 5B is side view, and FIG. 5C is a partial sectional view.

FIG. 6A is a plan view, FIG. 6B is side view, and FIG. 6C is a partial sectional view.

EXPLANATION OF REFERENCE

Figure 1:
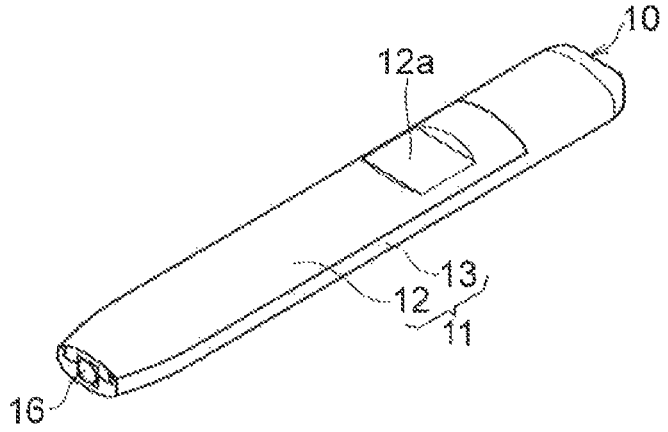
FIG. 1 is a perspective view illustrating Example 1 of a sliding makeup implement related to the invention.
Figure 2:
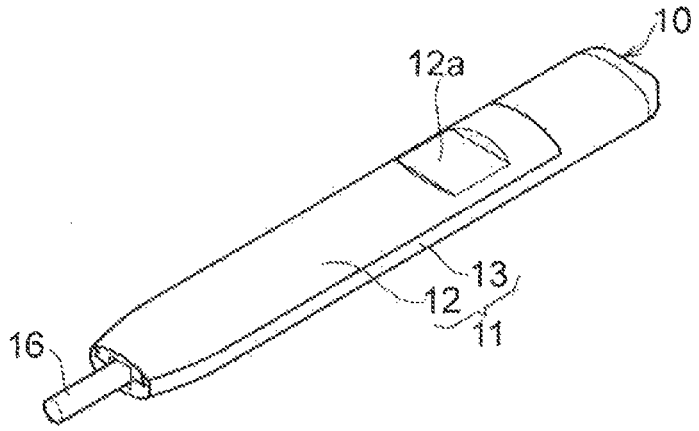
FIG. 2 is an explanatory view illustrating an advanced state of a core in the above.
Figure 3:
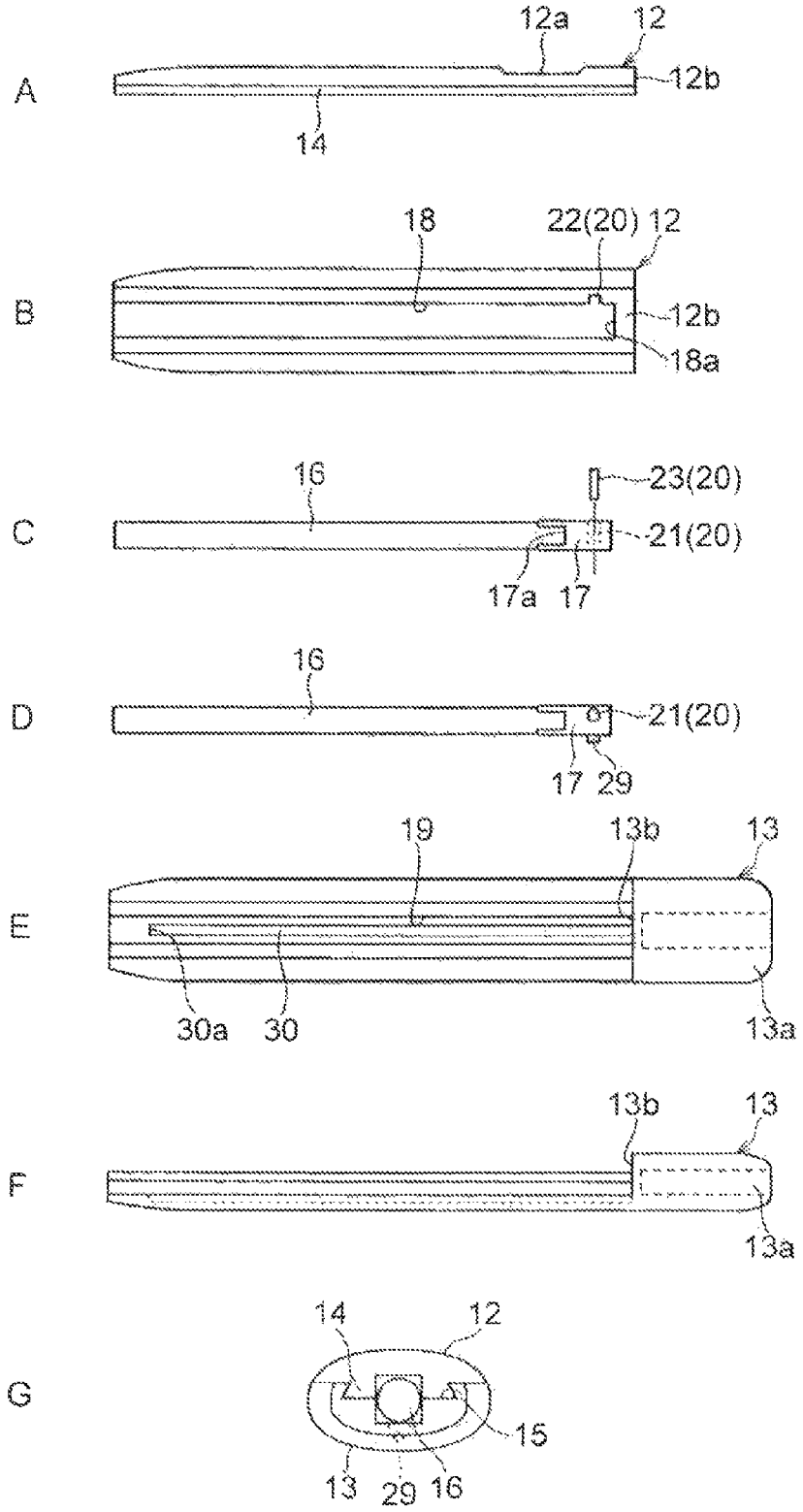
FIG. 3 also relates to Example 1.
Figure 4:
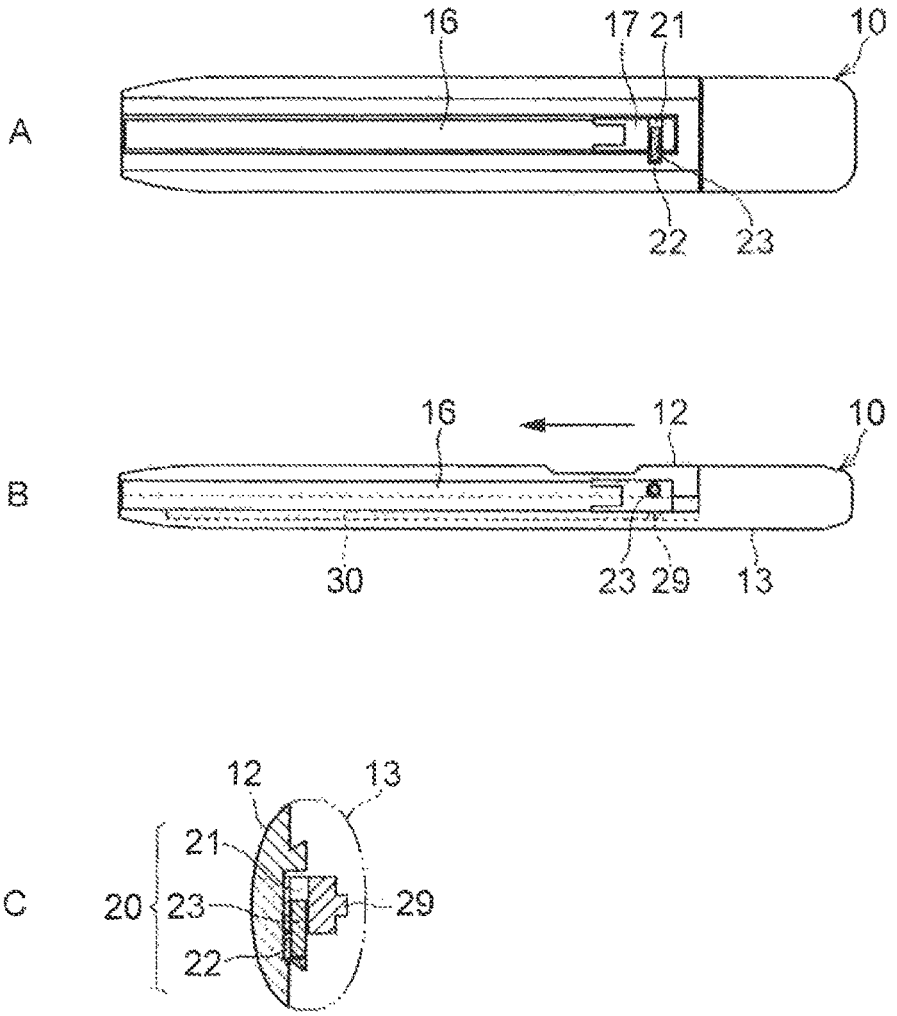
FIG. 4 also illustrate a usage state of Example 1.
Figure 5:
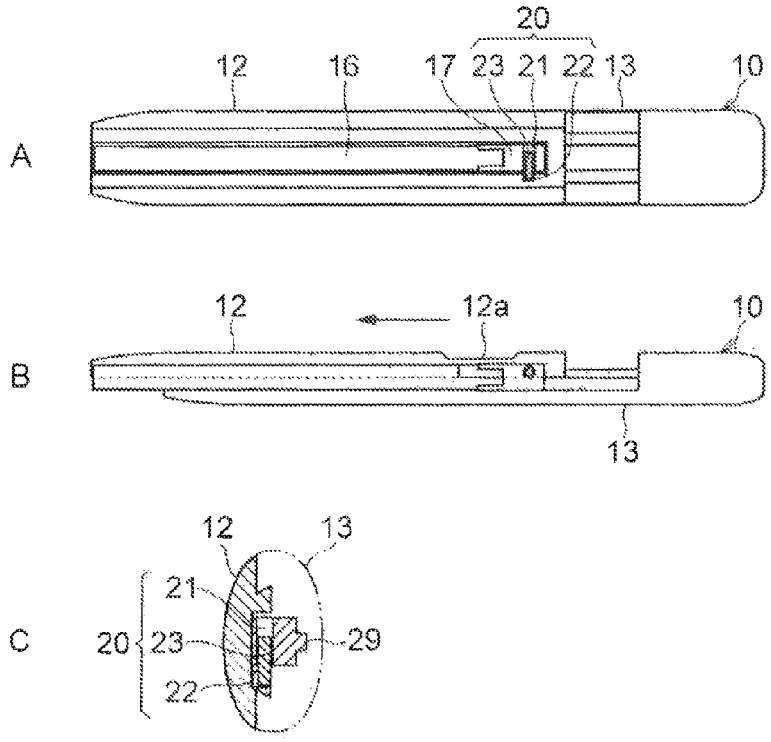
FIG. 5 also illustrate a state where a case member has been advanced.
Figure 6:
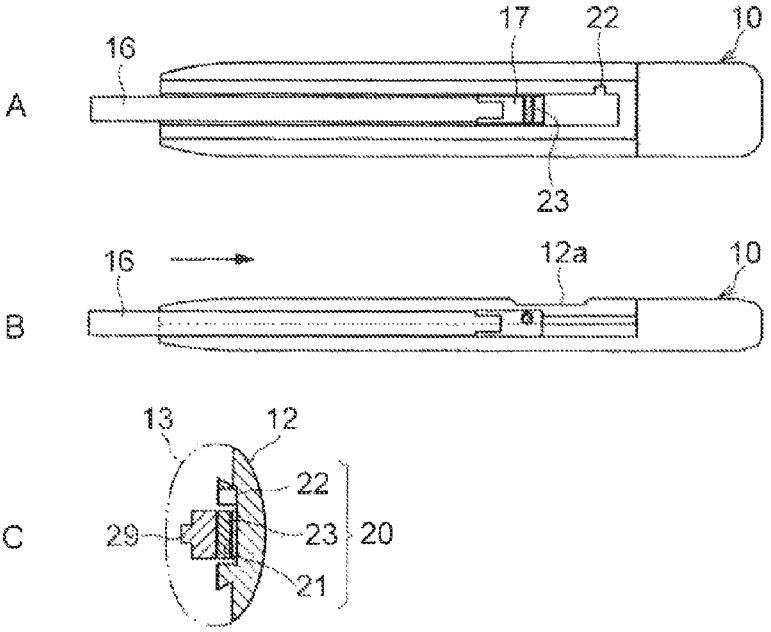
FIG. 6 also illustrate a state where the case member has been retracted.
Figure 7:
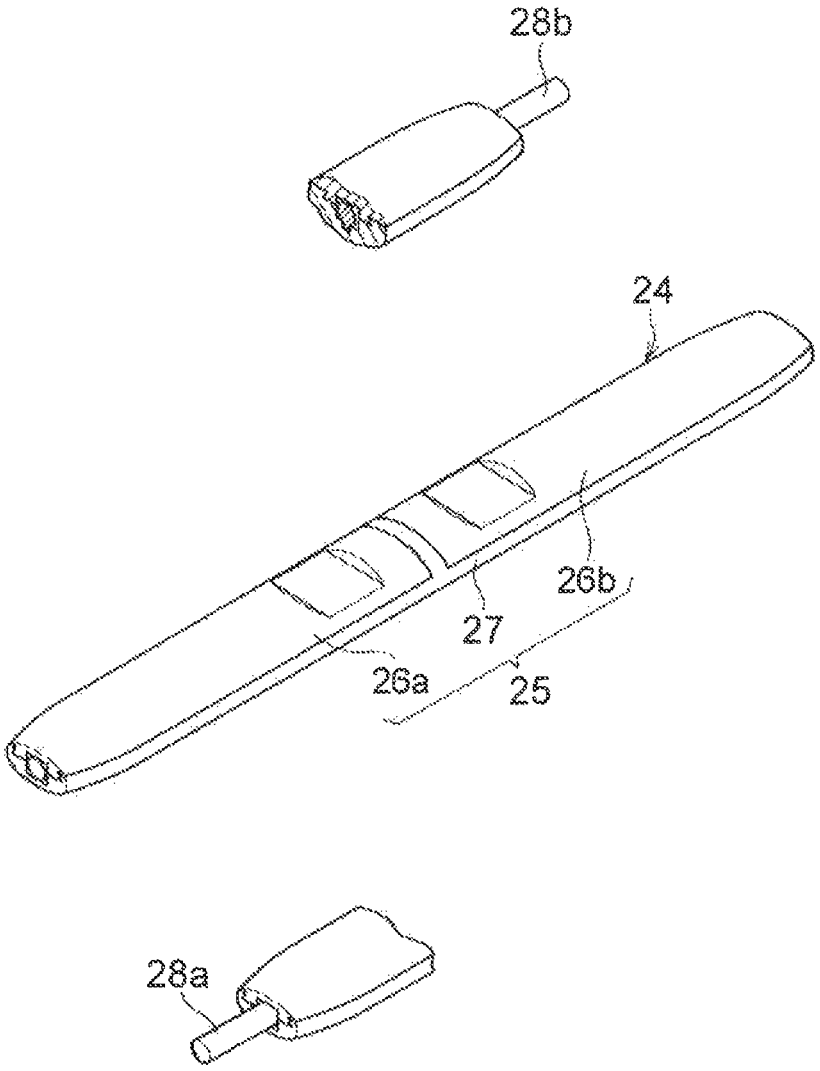
FIG. 7 is a per view illustrating Example 2 of a sliding makeup implement related to the invention.

10, 24: SLIDING MAKEUP IMPLEMENT
11, 25: CASE
12, 26*a*, 26*b*: ONE CASE MEMBER
13, 27: OTHER CASE MEMBER
14: CONVEX PORTION
15: CONCAVE PORTION
16, 28*a*, 28*b*: CORE
17: CORE HOLDER
18, 19: SLIDING GROOVE
20: COUPLING MEANS
21: FIRST COUPLING HOLE

22: SECOND COUPLING HOLE
23: COUPLING PIN
29: PROTRUSION
30: GUIDE GROOVE

The invention claimed is:

1. A sliding makeup implement having a configuration in which a rod-shape core used for makeup is capable of being advanced and retracted from a case when being used, the sliding makeup implement comprising:

a pair of case members that are obtained by dividing a case into two in a protruding direction of a rod-shaped core, the one divided case member being slidably combined with the other divided case member; sliding grooves the are respectively from in inner surfaces of the divided case member for arranging the rod-shaped core so that the core is capable of being advanced and retracted in an axial direction thereof;

a core holder that is moveable along the sliding grooves and holds the core at a base end thereof; and coupling means for pushing out the core by means of one case member and for bringing the one case member and the core into a coupled state when returning the pushed-out core to its original position, and for bringing the one case member and the core into an uncoupled state when leaving the core at the pushed-out position.

2. The sliding make-up implement according to claim 1, wherein the coupling means includes:

a first coupling hole that is found in a core holder in a direction intersection the axial direction of the core;

a second coupling hole that is formed in one of the case member and is located at a position where the second coupling hole is aligned with the first coupling hole when the core holder is located deep in the sliding grooves; and a coupling pin that is movably provided inside the first and second coupling holes, wherein the dimension of the coupling pin is set to be shorter than the length of the first coupling hole and longer than the length of the second coupling hole.

3. The sliding makeup implement according to claim 1, wherein the case is formed of a transparent material to make the movement invisible or an indicator showing a moved position is provided on the case, in order to grasp a position where the coupling means has moved, from the outside.

4. The sliding makeup implement according to claim 1, wherein the core holder has a fitting relationship in which the core holder is slidable along the sliding grooves and is capable of stopping at an arbitrary position, and a drag in the fitting is set to be greater than a pressure applied to the core when being used.

5. The sliding makeup implement according to claim 1, further comprising:

a core retaining mechanism in which the core holder is provided with a protrusion, a sliding groove is provided with a guide groove in which the protrusion is movable, and a tip of the guide groove is used as a stop part.

* * * * *